US006384410B1

(12) United States Patent
Kawato

(10) Patent No.: US 6,384,410 B1
(45) Date of Patent: May 7, 2002

(54) TIME-OF-FLIGHT MASS SPECTROMETER

(75) Inventor: Eizo Kawato, Cheadle (GB)

(73) Assignee: Shimadzu Research Laboratory (Europe) Ltd, Manchester (GB)

( * ) Notice: Subject to any disclaimer, the term of this patent is extended or adjusted under 35 U.S.C. 154(b) by 0 days.

(21) Appl. No.: 09/530,086

(22) PCT Filed: Jan. 12, 1999

(86) PCT No.: PCT/GB99/00086

§ 371 Date: Aug. 8, 2000

§ 102(e) Date: Aug. 8, 2000

(87) PCT Pub. No.: WO99/39369

PCT Pub. Date: Aug. 5, 1999

(30) Foreign Application Priority Data

Jan. 30, 1998 (GB) ..... 9802115

(51) Int. Cl.[7] ..... H01J 49/40

(52) U.S. Cl. ..... 250/287; 250/281; 250/282; 250/286

(58) Field of Search ..... 250/287, 281, 250/282, 286

(56) References Cited

U.S. PATENT DOCUMENTS 4,625,112 A 11/1986 Yoshida ..... 250/287
4,731,532 A 3/1988 Frey et al. ..... 250/287
5,160,840 A 11/1992 Vestal ..... 250/287
5,464,985 A 11/1995 Cornish et al. ..... 250/396 R
5,654,545 A * 8/1997 Holle et al. ..... 250/287
5,739,529 A * 4/1998 Laukien et al. ..... 250/287

FOREIGN PATENT DOCUMENTS

WO WO 98/01218 1/1998 ..... H01J/49/00

OTHER PUBLICATIONS

Karataev et al., "New Method for Focusing Ion Bunches in Time–of–Flight Mass Spectrometers," *Soviet Physics–Technical Physics*, 16:7, pp. 1177–1179 (1972).

Mamyrin et al., "The mass–reflectron, a new nonmagnetic time–of–flight mass spectrometer with high resolution," *Sov. Phys–JETP*, 37:1, pp. 45–48 (1973).

* cited by examiner

*Primary Examiner*—Jack Berman
*Assistant Examiner*—Nikita Wells
(74) *Attorney, Agent, or Firm*—Leydig, Voit & Mayer, Ltd.

(57) ABSTRACT

A time-of-flight mass spectrometer includes a gridless dual-stage ion reflector (10) having a high-field first stage (18) and a low-field second stage (19). The ratio of the electric field strength in the low-field second stage (19) to the electric field strength in the high-field first stage (18) is 0.55, and may be in the range 0.35 to 0.07.

17 Claims, 3 Drawing Sheets

TIME-OF-FLIGHT MASS SPECTROMETER

FIELD OF THE INVENTION

The present invention relates to time-of-flight mass spectrometers.

BACKGROUND OF THE INVENTION

In a time-of-flight mass spectrometer charged particles are analysed depending on their mass-to-charge ratios. This is accomplished by measuring the time difference between ions leaving an ion source and arriving at an ion detector. In known time-of-flight mass spectrometer arrangements ions created in an ion source are introduced into a field-free drift space and are reflected using an ion reflector. An ion reflector has a series of parallel electrodes which generates an electric field for reflecting ions back into the field-free drift space to be detected by the ion detector. Ions are pulsed or bunched in time at certain points downstream from the ion source to have smaller time deviations compared to their flight times. However, the ions will usually have a range of different kinetic energies, and so velocities, resulting in an undesirable spread of flight times, The ion reflector is used to compensate for this spread of flight times. The ions with larger velocities penetrate further into the ion reflector spending more time there before being reflected into the field free drift space where they spend less time. The electric field strength is chosen so that the increased and decreased times match to cancel each other.

An ion reflector having a uniform or linear electric field is called a single-stage reflector. This compensates for a spread of flight times, up to the first derivative of ion energy and so will only provide effective compensation for a relatively small range of energy spread. Single-stage reflectors have been successfully used in a wide range of applications, but are limited in their effectiveness.

Another type of the ion reflector which provides a wider range of energy compensation uses two stages each having a uniform electric field separated by a fine grid mesh. This is called a dual-stage reflector. In a dual-stage reflector, a short first stage reduces the initial energy of the ions by more than two thirds and has very high electric field strength. The ions, with now only less than one third of their initial energy, are reflected in the low electric field second stage, and this provides effective compensation for a spread of flight times up to the second derivative of ion energy.

The dual-stage reflector was first developed by Mamyrin et al. (B. A. Mamyrin, V. I. Karataev, D. V. Shmikk and V. A. Zagulin, Zh. Eksp. Teor. Fiz. 64, (1973) 82–89; Sov. Phys. JETP., 37 (1973) 45–48). It was believed that the best resolution could be obtained if the first stage is very short and has quite a high field strength compared to the second stage, i.e. the ratio of the electric field in the low-field second stage to the electric field in the high-field first stage is small. Typically, the first stage had a length of about 10% of the total reflector length. This is borne out by theory because the resolution derived from the condition for second order compensation is proportional to the ratio of the ion energy at the boundary of the two stages to the initial ion energy at the front of the reflector. The theoretical maximum for this ratio is one third, in which case the first stage length is infinitely small and the field strength of the first stage is infinitely large. Thus, the first stage length is selected so as to be as short as possible unless practical limitations, such as electric discharge or mesh size effect, cause serious problems. In practice, the energy reduction at the boundary of the two stages was set to be less than about 0.7 of the initial ion energy which is slightly larger than two thirds, and the ratio of the field strengths in the two stages was below 0.25.

The dual-stage reflector has excellent mass resolution, and is quite useful in most of the high resolution applications currently encountered. However, the requirement for a mesh or grid to separate the two stages of uniform electric field and also separating the reflector from the field-free drift space reduces the sensitivity of the apparatus because the ions must pass through a mesh or grid four times, thereby suffering substantial scattering and deflection. U.S. Pat. No. 4,731,532 describes an ion reflector designed to alleviate the reduced sensitivity by removing the grids or meshes, as shown in FIG. 1. However, the high field strength in the first stage causes field penetration into the second stage and also into the field-free drift space causing the equi-potential lines bent at both ends of the first stage. This bending of the field lines deflects the ions resulting in a shift of their flight times. These effects are corrected by attaching an additional electrode, called the focusing electrode, to the front of the first stage in order to alleviate the undesirable ion dispersion.

Other types of gridless reflector have been used for different purposes where there is a need to correct for a much wider range of energy spread. U.S. Pat. No. 4,625,112 describes an ion reflector which uses a quadratic electric field to reflect the ions and which, in theory, provides for perfect temporal correction provided there is no field-free drift space. U.S. Pat. No. 5,464,985 discloses an ion reflector using a curved electric field. Both of these patents embody an increasing electric field starting from zero, or close to zero, at the front end of the reflector so that the field distortion caused by using gridless electrodes will be small compared to that produced in a gridless dual-stage reflector. On the other hand, an electric field strength which increases along the reflector axis gives rise to small but successive ion divergence, and this reduces the sensitivity.

It is an object of the present invention to provide a gridless dual-stage ion reflector which substantially alleviates the aforementioned problems.

It is another object of the invention to provide a convenient method for adjusting the time focal plane of a gridless dual-stage ion reflector whereby to correct for any misalignment.

SUMMARY OF THE INVENTION

According to one aspect of the invention there is provided a time-of-flight mass spectrometer comprising an ion source for generating an ion beam, a field-free drift region, a gridless dual-stage ion reflector and an ion detector for generating a signal indicative of the ion beam, the gridless dual-stage ion reflector including a plurality of disc electrodes having central apertures through which the ion beam can pass and a final plate electrode, said electrodes being supplied, in use, with voltages defining a high-field first stage having a substantially uniform electric field, and a low-field second stage also having a substantially uniform electric field, the field strength of the second stage having a ratio to that of the first stage in the range from 0.35 to 0.7.

According to another aspect of the invention there is provided a gridless dual-stage ion reflector comprising a plurality of disc electrodes having central apertures through which an ion beam can pass and a final plate electrode, the electrodes being supplied, in use, with voltages defining a high-field first stage having a substantially uniform electric field and a low-field second stage also having a substantially uniform electric field, the field strength of the second stage having a ratio to that of the first stage in the range from 0.35 to 0.7.

According to a yet further aspect of the invention there is provided a method for adjusting the time focal plane of a gridless, dual-stage ion reflector as defined in the immediately preceding paragraph, including adjusting in opposite directions said voltages defining said first and second stages to set a selected ratio of the field strength of the second stage to that of the first stage in said range from 0.35 to 0.7, and then adjusting the voltages in the same direction, while maintaining said selected ratio.

As a result of investigations carried out by the inventor, it was found that the hitherto-used grid or mesh electrodes provided at the front of a dual-stage ion reflector and at the boundary between the first and second stages can be replaced by gridless electrodes, and that the difference in field strengths in the two stages can be reduced significantly if the first stage is not too short. In fact, it was found that the ratio of electric field strength in the low-field second stage to the electric field strength in the high-field first stage is optimally 0.55, and that ratios in the range 0.35 to 0.7 are also useful. By adopting a ratio in this range, distortion of the equipotential lines due to field penetration from the higher field stage is reduced.

Inevitably there will be some penetration of the higher field strength of the first stage into the field-free drift space and into the second stage which has a lower field strength and this gives rise to a small shift in the time focal plane. However, this small shift can easily be compensated for by applying a small change to the ratio of the field strengths in the two stages. Another important finding is that the longer first stage, compared to a known dual-stage reflector, provides relatively small field penetration or, in other words, lower distortion of the equi-potential lines at both ends of the first stage. These distortions can be regarded an aperture lenses which can be used to change the trajectories of ions to be focused into the ion detector.

A parallel ion beam is caused to diverge on entering the first high-field first stage. This beam continues to diverge due to deceleration in the first stage. However, at the boundary of the first and second stages the ion beam is caused to converge and can be made parallel to the reflector axis by carefully choosing the ratios of the first stage length and of the diameter of the central apertures with respect to the length of the field-free drift space, and the ratio of the field strengths in two stages. The diameter of the central apertures may be within a range from 0.02 to 0.04 of the total free flight length and/or the length of the first stage may be within a range from 0.04 to 0.1 of the length of the total free flight length. Then, the ion beam is reflected parallel to the axis again in the second stage and follows the same trajectory on the way back. This situation is useful because the focal length of the reflector becomes infinite and ions originating at the ion source will maintain the same angle to the reflector axis after reflection by the ion reflector and will approach the ion detector without divergence. Additionally, by slightly reducing the first stage length a lens power due to field distortion at the boundaries becomes slightly stronger. This modification causes the reflector to act like a weakly converging lens which is quite useful to spatially focus the ion beam in to the ion detector.

It was also confirmed that the described ion reflector can be used in the configuration where the reflector is inclined from the axis of the ion beam penetrating into the reflector and the ion detector is positioned off-axis accordingly. A small shift in the time focal plane which determines the flight path can again be compensated for by adjusting the field strength. The ion detector may have a detector surface perpendicular to the ion beam axis, or may be inclined at an angle which is twice as large as the angle of inclination of the reflector, or may be at a small angle around that angle. Adjusting the field strength can also compensate for this change.

BRIEF DESCRIPTION OF THE DRAWINGS

Embodiments of the invention will now be described, by way of example only, with reference to the accompanying drawings of which.

DETAILED DESCRIPTION OF PREFERRED EMBODIMENTS

Figure 1:
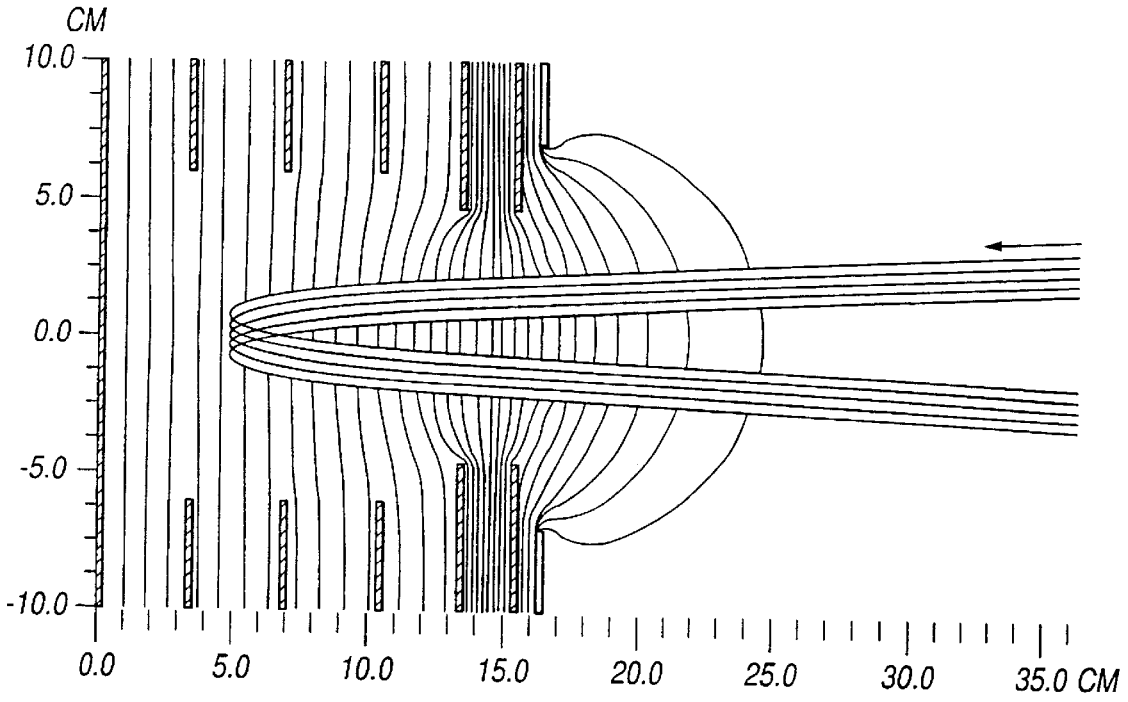
Fig. 1 (PRIOR ART)
FIG. 1 shows a longitudinal sectional view through a known gridless ion reflector.
Figure 2:
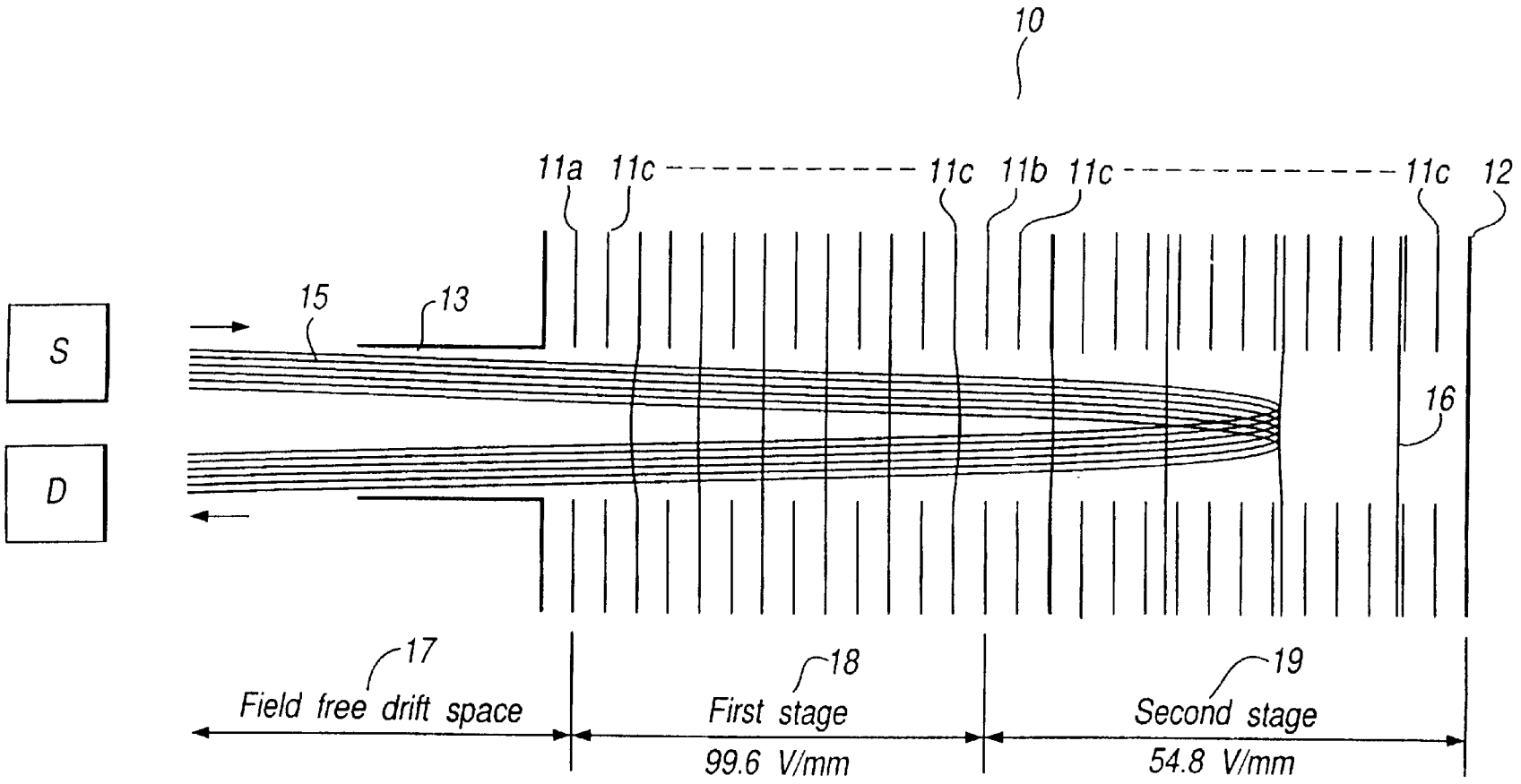
FIG. 2 shows a longitudinal sectional view through a gridless dual-stage ion reflector according to the invention.

Referring to FIG. 2, the gridless dual-stage ion reflector 10 is located at one end of the field-free drift space 17 which determines a total free flight length of 1 m between an ion source S and an ion detector D. The dual-stage reflector 10 consists of a first stage 18 bounded by disc electrodes 11*a* and 11*b* and a second stage 19 bounded by a disc electrode 11*b* and a final plate electrode 12. These two stages 18 and 19 contain equally-spaced disc electrodes 11*c* spaced apart at 5 mm intervals. The disc electrodes 11 (11*a*, 11*b* and 11*c*) have an aperture 25 mm in diameter and are supplied with appropriate voltages via a resistor array (not shown) to give uniform electric fields of 99.6V/mm and 54.8V/mm in the first and second stages, respectively, i.e the electric field strength in the low and high field stages are in the ratio 0.55. The final plate electrode 12 is located with the same 5 mm spacing and has a depression 25 mm in diameter and a depth equal to half the thickness of the disc electrodes 11 whereby to maintain a smooth electric field strength at the end of the second stage 19. The voltage applied to the final plate electrode 12 is chosen in the same manner as that for the disc electrodes 11 so as to provide a uniform electric field strength in the second stage 19. A shield electrode 13 which has an inside diameter of 25 mm is located in front of the ion reflector to reduce field interference from the electrical connections and it is electrically connected to electrode 11*a*. In this example an ion beam 15 enters the first stage 18 with an energy of 9000 eV and is decelerated, suffering divergence due to the curvature of the electric field. Equipotential lines 16 are shown in steps of 1 kv to depict the field distortion at both sides of the first stage which is quite small compared to hitherto known dual-stage reflectors. After passing through the first stage 18, the ion beam 15 enters the second stage 19 where the electric field has the opposite sign of curvature, and the ion beam 15 is converged. By choosing the ratio of field strengths to be about 0.55 the ion trajectories will be substantially parallel at and close to the turning point in the reflector, where the space potential relative to the field-free drift space is close to 9000V. Likewise, the electric fields have the same effect on the return path and the ion beam 15 has near parallel or slightly convergent trajectories after reflection into the field-free drift space 17. This feature gives good spatial focusing of the ion beam 15 into the ion detector after passing through the 1 m field-free flight length as well as good time compensation at the ion detector surface for ions having different kinetic energies.

In this embodiment the disc electrodes 11*a*, 11*b* and 11*c* all have the same shape. However, the inner diameter of the intermediate disc electrodes 11*c* can be different from that of the disc electrodes 11*a* or 11*b*. The final plate electrode 12 has a depression, but, instead, it may be flat, but with an increased separation equal to half the thickness of the disc electrodes 11 in order to maintain uniform field strength at the far end of the second stage. Alternatively, the length of the second stage could be increased to such an extent that ions having the maximum energy do not reach the region of the non-uniformity. The final flat electrode may incorporate a mesh or grid instead of having a solid surface whereby to facilitate neutral particle detection or usage as a linear time-of-flight spectrometer.

Figure 3A:
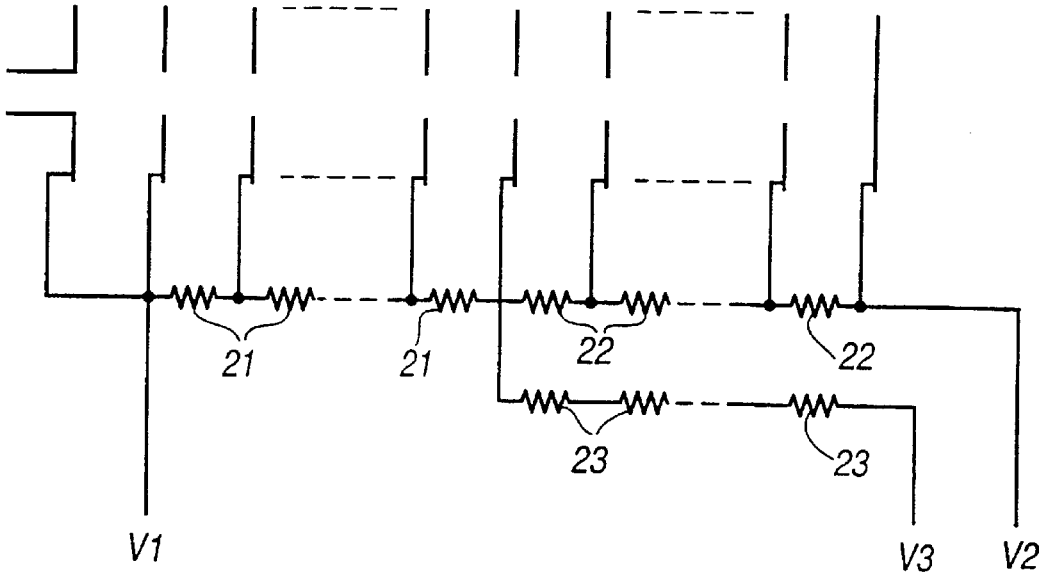
FIGS. 3*a* and 3*b* show different resistor networks for use in the ion reflector of FIG. 2.

FIG. 3*a* shows a resistor network for controlling field strength and the ratio of the field strengths in the two stages 18,19. The disc electrodes in the first stage 18 are connected to the resistor array 21 consisting of resistors having the same resistance value. The first disc electrode 11*a* and the shield electrode 13 are directly connected to the same voltage source V1 as is the electrode which surrounds the field free drift space 17. In the second stage 19, the disc electrodes are likewise connected to the resistor array 22 consisting of resistors having the same resistance value and the final plate electrode 12 is connected, as shown, to the voltage source V2. Disc electrode 11*b* which separates the two stages is connected to one end of another resistor array 23 and the other end of the resistor array 23 is connected to the voltage source V3. The total resistance value of the resistor array 21 and a combined resistance of resistor arrays 22 and 23 are in the same, or close to the same, ratio as the required field strengths for the two stages 18,19. As the total resistance value of the resistor array 23 is chosen to be the same as that of the resistor array 22, a combined resistance of resistor arrays 22 and 23 is half of the total resistance of resistor array 22. When the ratio of the total resistance value of resistor array 21 and half the total resistance of the resistor array 22 is the same as that of the required field strengths the voltages of V2 and V3 are set to the same design value. Thus, in this example, V1 supplied directly to the drift tube forming the field-free drift space 17 is set to −10 kV, and V2 and V3 are set to +548V by two variable voltage power supplies. However, if the total resistance values are in a different ratio, the voltages V2 and V3 will need to be adjusted by the application of offset voltages in order to produce the required field ratios. In the described embodiment the field-free drift space 17 is maintained at −10 kV in order to pass an ion beam of 9 keV.

In a practical embodiment the ion reflector will inevitably include errors in precision of construction, or errors in the electric fields due to the finite thickness of the electrodes or the termination of the parallel field in a finite size, or errors in the accuracy of the resistor arrays. Such errors shift the time focal plane from the designed position. In this embodiment, the time focal plane can be moved further out by increasing the relative field strength of the second stage, but the optimum resolution is achieved within a narrow range of the field strength ratio around 0.55. Furthermore, by increasing the field intensities in the two stages, while keeping the field strength ratio constant, the time focal plane can be moved slowly away from the reflector. Thus, a procedure designed to obtain the optimum operational conditions involves firstly adjusting the voltages V2 and V3 in opposite directions to set the ratio of field strengths in the two stages to be around 0.55 and then adjusting the voltages V2 and V3 in the same direction while maintaining the ratio of field strengths almost constant. Repeating this procedure provides an easy and quick method for achieving the best resolution without any adjustment of hardware components such as the position of the ion detector or of the reflector.

Figure 3B:
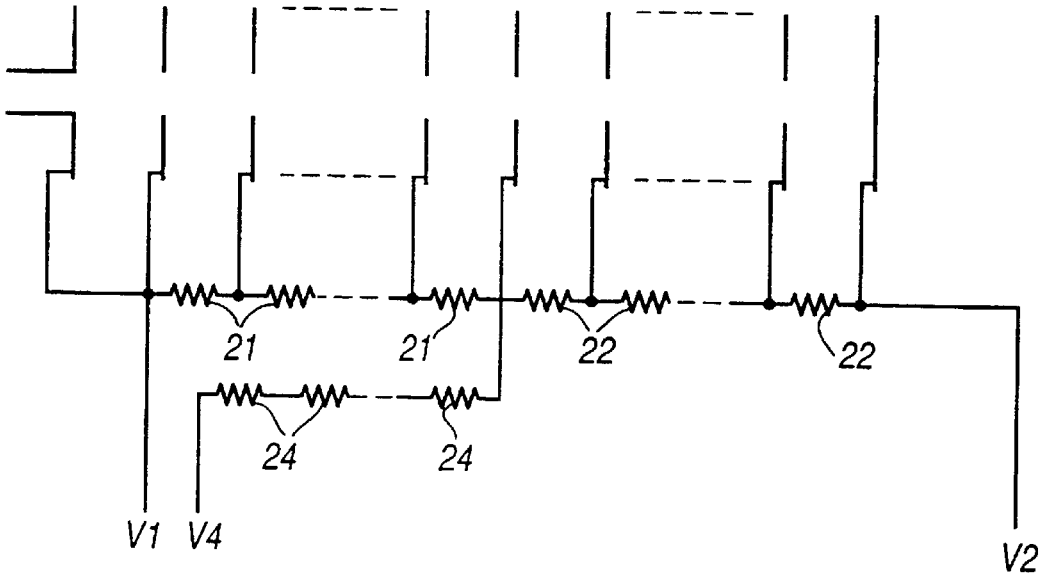

FIG. 3*b* illustrates another resistor array for controlling field strength and for setting the ratio of field strengths in the first and second stages 18,19. In this embodiment, resistor array 23 is replaced by a resistor array 24 which has a total resistance value equal to that of resistor array 21, and the end of the resistor array is connected to the voltage source V4. This is convenient for the case where the drift tube is at ground voltage and V1 is simply grounded. The voltage V2 is supplied by a variable high voltage power supply or a fixed voltage high voltage supply having an associated variable resistor connected in series. The voltage V4 is supplied by a variable voltage power supply. Adjusting voltages V2 and V4 in the manner as described above in the first example provides a method for optimising the resolution of the reflector.

What is claimed is:

1. A time-of-flight mass spectrometer comprising an ion source for generating an ion beam, a field-free drift region, a gridless dual-stage ion reflector and an ion detector for generating a signal indicative of the ion beam, the gridless dual-stage ion reflector including a plurality of disc electrodes having central apertures through which the ion beam can pass and a final plate electrode, said electrodes being supplied, in use, with voltages defining a high-field first stage having a substantially uniform electric field, and a low-field second stage also having a substantially uniform electric field, the field strength of the second stage having a ratio to that of the first stage in the range from 0.35 to 0.7.

2. A time-of-flight mass spectrometer as claimed in claim 1, wherein the diameter of said central apertures is within a range from 0.02 to 0.04 of the total free flight length.

3. A time-of-flight mass spectrometer as claimed in claim 1, wherein the length of said first stage is within a range from 0.04 to 0.10 of the total free flight length.

4. A time-of-flight mass spectrometer as claimed in claim 1, wherein said final plate electrode has a depression.

5. A time-of-flight mass spectrometer as claimed in claim 1, wherein a surface of said final plate electrode is formed by a mesh or grid.

6. A time-of-flight mass spectrometer as claimed in claim 1, wherein said gridless dual-stage ion reflect has a shielding electrode in front of said first stage.

7. A time-of-flight mass spectrometer as claimed in claim 1, wherein said ion source generates a pulsed ion beam.

8. A time-of-flight mass spectrometer as claimed in claim 7, wherein said pulsed ion beam is a laser-produced ion beam.

9. A time-of-flight mass spectrometer as claimed in claim 7, wherein said pulsed ion beam is produced by pulsed extraction from an ion trapping device.

10. A time-of-flight mass spectrometer as claimed in claim 9, wherein the ion trapping device is a quadrupole ion trap, a penning trap or an ion cyclotron resonance cell.

11. A time-of-flight mass spectrometer as claimed in claim 1, wherein said voltage are generated using resistor arrays so arranged as to provide said uniform electric fields within the first and second stages.

12. A time-of-flight mass spectrometer as claimed in claim 11, including an additional resistor array connected to an intermediate disc electrode separating the first and second stages, and having a total resistance value equal to the total resistance value of another said resistor array used to generate the voltages supplied to the electrodes of one of said stages.

13. A gridless dual-stage ion reflector comprising a plurality of disc electrodes having central apertures through which an ion beam can pass and a final plate electrode, said electrodes being supplied, in use, with voltages defining a high-field first stage having a substantially uniform electric field, and a low-field second stage also having a substantially uniform electric field, the field strength of the second stage having a ratio to that of the first stage in the range from 0.35 to 0.7.

14. A gridless dual-stage ion reflector as claimed in claim 13, wherein said final plate electrode has a depression.

15. A gridless dual-stage ion reflector as claimed in claim 13, wherein a surface of said final plate electrode is formed by a mesh or grid.

16. A method for adjusting the time focal plane of a gridless dual-stage ion reflector as claimed in claim 13, including adjusting one of said field strengths of said first and second stages to set a selected ratio of the field strength of the second stage to that of the first stage in said range from 0.35 to 0.7, and then adjusting both said field strengths while maintaining said selected ration.

17. A method as claimed in claim 16 including repeating the adjustments one or more time.

* * * * *